United States Patent [19]

Ishizuka

[11] Patent Number: 4,480,973

[45] Date of Patent: Nov. 6, 1984

[54] VANE COMPRESSOR PROVIDED WITH ENDLESS CAMMING SURFACE MINIMIZING TORQUE FLUCTUATIONS

[75] Inventor: Yutaka Ishizuka, Saitama, Japan

[73] Assignee: Diesel Kiki Co., Ltd., Saitama, Japan

[21] Appl. No.: 395,867

[22] Filed: Jul. 7, 1982

[30] Foreign Application Priority Data

Jul. 13, 1981 [JP] Japan ..... 56-108965

[51] Int. Cl.[3] ..... F04C 18/00

[52] U.S. Cl. ..... 418/150; 418/259

[58] Field of Search ..... 418/150, 259, 266, 260–265

[56] References Cited

U.S. PATENT DOCUMENTS

| | | | |
|---|---|---|---|
| 2,347,944 | 5/1944 | Fowler | 418/150 |
| 2,832,199 | 4/1958 | Adams et al. | 418/15 X |
| 3,717,423 | 2/1973 | Petersen et al. | 418/150 X |
| 3,890,071 | 6/1975 | O'Brien | 418/260 |

FOREIGN PATENT DOCUMENTS

| | | | |
|---|---|---|---|
| 535216 | 4/1941 | United Kingdom | 418/150 |
| 937389 | 9/1963 | United Kingdom | 418/150 |

*Primary Examiner*—John J. Vrablik

*Assistant Examiner*—T. Olds

*Attorney, Agent, or Firm*—Frishauf, Holtz, Goodman and Woodward

[57] ABSTRACT

The endless camming peripheral surface of the pump housing, which performs one cycle of suction, compression and discharge of fluid in cooperation with the vanes and the rotor, comprises an increasing radius portion along which the amount of protrusion of each vane gradually increases with movement of the vane, and first and second decreasing radius portions along which the amount of protrusion gradually decreases with movement of the vane, the three portions being successively arranged in the order mentioned in the advancing direction of the vanes. Each of the three portions has such a cam profile that the velocity of radial movement of each vane varies at a rate gradually decreasing as the vane approaches the terminating end of the portion. Preferably, the above one-cycle performing portion further includes one or two constant radius portions located between the above three portions, along which the amount of protrusion of each vane is kept substantially constant with movement of the vane.

10 Claims, 11 Drawing Figures

VANE COMPRESSOR PROVIDED WITH ENDLESS CAMMING SURFACE MINIMIZING TORQUE FLUCTUATIONS

BACKGROUND OF THE INVENTION

This invention relates to vane compressors adapted for use in air conditioning systems or the like, and more particularly to vane compressors provided with improved camming surfaces which minimize torque fluctuations.

As known e.g. from U.S. Pat. No. 3,834,846, a vane compressor in general comprises a drive shaft arranged to be rotated by a prime mover, a rotor arranged for rotation in unison with the drive shaft and having an outer peripheral surface formed therein with a plurality of slits, a plurality of vanes radially movably fitted in the slits of the rotor, and a pump housing having an inner peripheral surface formed as an endless camming surface and in which the rotor and the vanes are received. The rotor, the vanes and the pump housing cooperatively define therebetween at least one pumping chamber. As the rotor rotates, gaseous fluid such as refrigerant gas is sucked into the pumping chamber, compressed therein and discharged therefrom.

In the above vane compressor, the endless camming surface of the pump housing, along which the vanes slidingly move in unison with the rotating rotor, has an elliptical cam profile in the type where the pump housing has two pumping chambers defined therein, and a circular cam profile in the type where the pump housing has a single pumping chamber defined therein.

However, conventionally no particular consideration was given to minimizing fluctuations in the torque acting upon the rotor in designing the cam profile of the endless camming surface. Therefore, the conventional vane compressor has large torque fluctuations during each cycle of suction, compression and discharge of fluid, which causes occurrence of operating noise and vibrations of the compressor during operation of the compressor.

OBJECT AND SUMMARY OF THE INVENTION

It is the object of the invention to provide a vane compressor in which the pump housing has an endless camming surface having a novel cam profile minimizing the torque fluctuations, thus reducing operating noise and vibrations of the compressor.

According to the present invention, the endless camming surface of the pump housing has at least one portion for performing one cycle of suction, compression and discharge of fluid in cooperation with the vanes and the rotor, which portion comprises: an increasing radius portion along which the amount of protrusion of each vane from the rotor gradually increases with movement of the vane; a first decreasing radius portion along which the amount of protrusion of each vane from the rotor gradually decreases with movement of the vane; and a second decreasing radius portion along which the amount of protrusion of each vane from the rotor gradually decreases with movement of the vane. The increasing radius portion and the first and second decreasing radius portions are successively arranged in the order mentioned in the moving direction of the vanes. Each of the three portions has such a cam profile that the velocity of radial movement of each vane varies at a rate gradually decreasing as the vane approaches the terminating end of the portion.

Preferably, the above one-cycle performing portion of the endless camming surface further includes at least one of: a first constant radius portion located between the increasing radius portion and the first decreasing radius portion, along which the amount of protrusion of each vane from the rotor is kept substantially constant with movement of the vane; a second constant radius portion located between the first decreasing radius portion and the second decreasing radius portion, along which the amount of protrusion of each vane from the rotor is kept substantially constant with movement of the vane; and at least one third constant radius portion arranged either at a location immediately preceding the increasing radius portion or a location immediately following the second decreasing radius portion.

The above and other objects, features and advantages of the invention will be more apparent from the ensuing detailed description taken in connection with the accompanying drawings in which:

DETAILED DESCRIPTION

Figure 1:
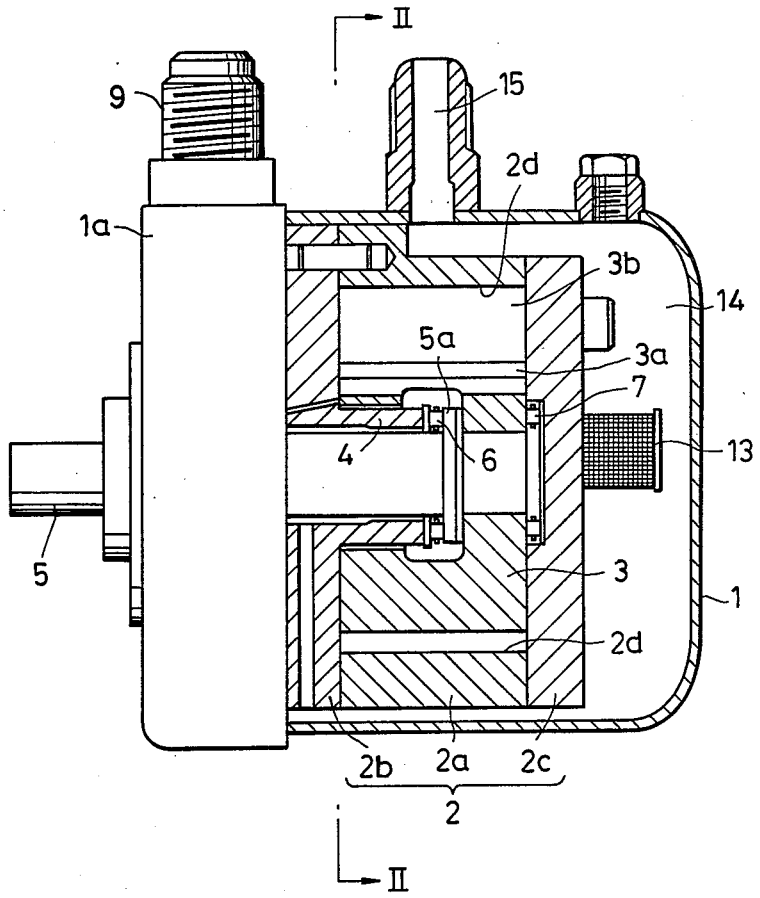
FIG. 1 PRIOR ART
FIG. 1 is a side view of a typical conventional vane compressor of the double pumping chamber type, with its essential part shown in longitudinal section.
Figure 2:
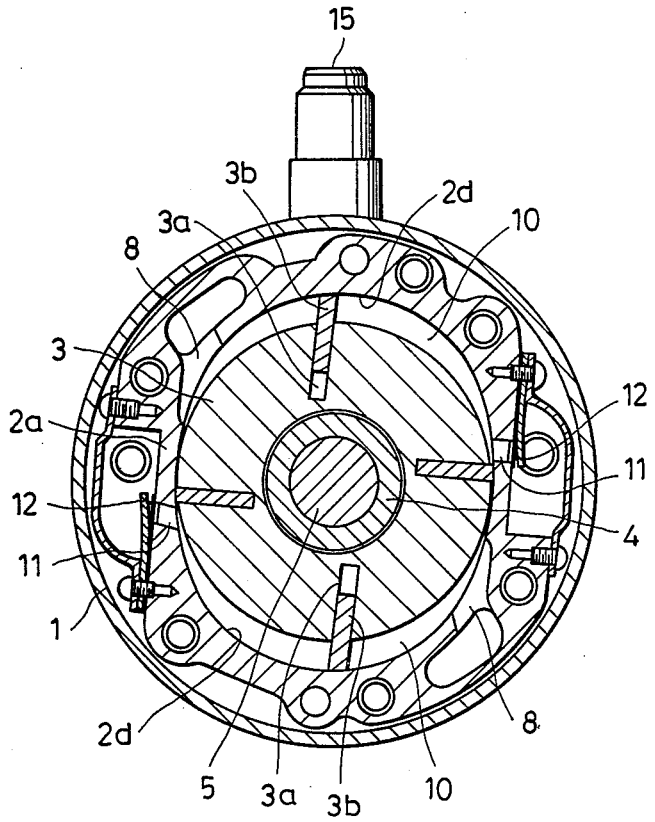
FIG. 2 PRIOR ART
FIG. 2 is a sectional view taken along line II—II in FIG. 1.

Referring to FIGS. 1 and 2, there is illustrated a typical conventional vane compressor having two pumping chambers. A pump housing 2 is enclosed by an outer shell 2, which housing is formed by a cam ring 2*a*, a front side block 2b and a rear side block 2c. The cam ring 2a has its inner peripheral surface 2d acting as a camming surface. Rotatably fitted in the pump housing 2 is a cylindrical rotor 3 which has its peripheral surface formed therein with a plurality of axial slits 3a and carries a plurality of plate-like vanes 3b radially movably fitted in the respective slits 3a. The rotor 3 is securedly fitted on an inner end of a drive shaft 5 rotatably supportedly extending through a bearing portion 4 formed integrally on the front side block 2b. The drive shaft 5 has a radial flange 5a formed integrally at its inner end and axially bearing against the inner end face of the bearing portion 4 by means of a thrust bearing 6, whereas the rotor 3 axially bears against the inner surface of the rear side block 2c by means of a thrust bearing 7. With this arrangement, as the drive shaft 5 rotates, the rotor 3 is rotated in unison with the drive shaft 5. Centrifugal force produced by the rotation of the rotor 3 and back pressure of lubricant oil acting upon the vanes 3b at the bottoms of the slits 3a cooperate to radially outwardly force the vanes 3b into sliding contact at their tips with the camming peripheral surface 2d. Thus, the vanes 3b are slidingly moved along the camming peripheral surface 2d in a clockwise circumferential direction as viewed in FIG. 2, in unison with the rotating rotor 3. Each time one of the vanes 3b passes by a pump inlet 8 formed in the inner peripheral surface of the cam ring 2a, compressing fluid is sucked into a pumping chamber 10 defined by adjacent vanes 3b, the camming peripheral surface 2d and the inner surfaces of the side blocks 2b, 2c, through a suction connector 9 provided on a front head 1a. Each pumping chamber 10 has its spatial volume varying from a minimum value to a maximum value during the suction stroke, and varying from a maximum value to a minimum value during the compression stroke. The fluid thus sucked into the chamber 10 and compressed therein is discharged through a pump outlet 11 and a discharge valve 12 forcedly opened by the compressed fluid. The above operating cycle is repeatedly carried out. The compressed fluid is discharged into a delivery pressure chamber 14 defined between the pump housing 12 and the outer shell 1, after having lubricant oil mixed therein separated therefrom by a lubricant oil separator 13, and then is delivered through a discharge connector 15 into an external circuit, not shown, after temporarily staying in the chamber 14.

In the vane compressor having the above-described arrangement and operation, the camming peripheral surface 2d of the cam ring 2a has an elliptical cam profile in the double pumping chamber type, and a circular cam profile in the single pumping chamber type. Since these cam profiles are not specially adapted for reducing the torque fluctuations, the compressor undergoes large torque fluctuations during each cycle of suction, compression and discharge of fluid, resulting in the occurrence of operating noise and vibrations of the compressor.

I have made many studies and tests in an attempt to obtain a cam profile for the camming peripheral surface, which can minimize the torque fluctuations in a vane compressor, and as a result I reached the finding that a cam profile satisfying the below-mentioned requirements can minimize the torque fluctuations:

(1) The compression stroke length should be as large as possible;

(2) The timing of an increase in the compressing pressure in an initial low torque region of each operating cycle should be advanced so as to obtain increased overlapped portions of the torque curves obtained by the individual vanes. Consequently, the torque fluctuations obtained by the individual vanes are averaged to provide a generally flattened torque curve; and (3) The amount of protrusion of each vane from the rotor should be small enough to reduce the value of peak torque during the high pressure compression stroke.

Figure 3:
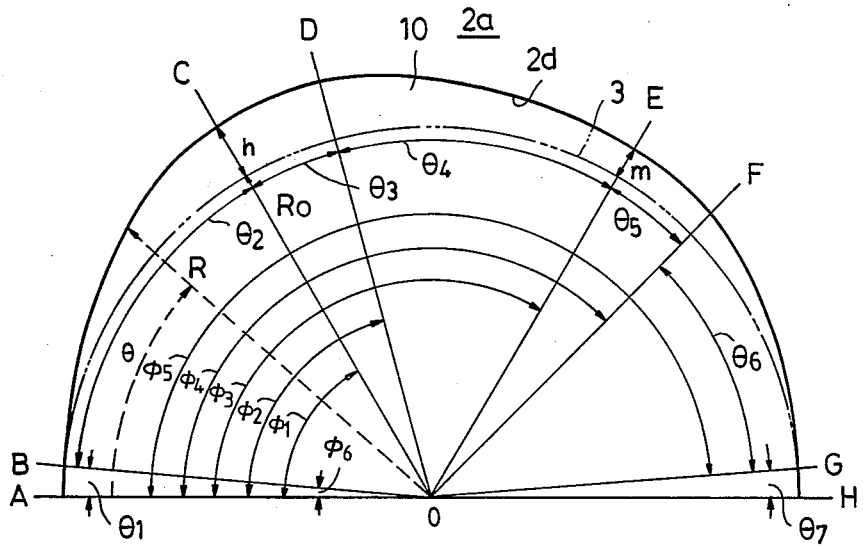
FIG. 3 is a schematic view showing a whole cam profile for the camming peripheral surface according to one embodiment of the present invention.

Referring next to FIG. 3 through FIG. 10, there is illustrated one embodiment of the present invention applied to a double pumping chamber-type vane compressor. The vane compressor according to the present invention has an identical construction with that of the conventional vane compressor previously described and shown in FIGS. 1 and 2, except the cam profile of the camming peripheral surface. Therefore, description of the construction of the vane compressor of the invention is omitted here. According to the present invention, the camming peripheral surface has a whole cam profile as shown in FIG. 3. In FIG. 3, reference numeral 2d designates a camming peripheral surface formed along the inner peripheral surface of the cam ring 2a, 3 a half portion of the outer peripheral surface of the rotor having a radius Ro and circumferentially extending through an angle of 180 degrees. One operating cycle of suction, compression and discharge of fluid is effected as the vanes move along this half portion. The camming peripheral surface 2d circumferentially extending through 180 degrees comprises the below-mentioned curved surface elements. Two camming peripheral surfaces each shown in FIG. 3 are symmetrically arranged to form the whole camming peripheral surface along which two operating cycles are successively carried out with movement of the vanes. In the following description, symbol $\theta$ represents the angle assumed by the tip of each vane relative to an intersecting point of the line A with the camming peripheral surface with respect to the center O of the rotor, and R the distance between the center O of the rotor and the camming peripheral surface:

a. A first regularly circular portion AB along which sealing is effected between the rotor 3 and the cam ring 2a, and which satisfies the relationships of: $0° \leqq \theta \leqq \Phi 6$ and $R = Ro$;

b. An increasing radius portion BC along which the amount of protrusion of each vane from the rotor gradually increases with movement of the vane, and which satisfies the relationships of $\Phi 6 < \theta \leqq \Phi 1$ and R increasing from Ro to Ro+h where h represents the amount of protrusion of the vane from the rotor at the terminating end of the portion BC;

c. A first constant radius portion CD along which the vane protruding amount is kept substantially constant with movement of the vane, and which satisfies the relationships of $\Phi 1 < \theta \leqq \Phi 2$ and $R = Ro + h$;

d. A first decreasing radius portion DE along which the vane protruding amount gradually decreases with movement of the vane, and satisfies the relationships of $\Phi 2 < \theta \leqq \Phi 3$ and R decreasing from Ro+h to Ro+m, where m represents the amount of protrusion of the vane from the rotor at the terminating end of the portion DE and is smaller than h;

e. A second constant radius portion EF along which the vane protruding amount is kept substantially constant with movement of the vane, and which satisfies the relationships of $\Phi 3<\theta \leqq \Phi 4$ and $R=Ro+m$;

f. A second decreasing radius portion along which the vane protruding amount gradually decreases with movement of the vane, and which satisifes the relationship of $\Phi 4<\theta \leqq \Phi 5$ and R decreasing from Ro+m to Ro; and g. A second regularly circular portion GH along which sealing is effected between the rotor 3 and the cam ring 2*a*, and which satisfies the relationships of $\Phi 5<\theta \leqq 180°$ and $R=Ro$.

The above curved surface elements AB, BC, CD, DE, EF, FG and GH circumferentially extend, respectively, through the following angles $\theta_1$, $\theta_2$, $\theta_3$, $\theta_4$, $\theta_5$, $\theta_6$ and $\theta_7$ with respect to the center O of the rotor:

(i) First Regularly Circular Portion AB: $0° \leqq \theta_1 \leqq 10°$ $(=\Phi 6)$;

(ii) Increasing Radius Portion BC: $45° \leqq \theta_2 < 90°$ $(=\Phi 1-\Phi 6)$;

(iii) First Constant Radius Portion CD: $0° \leqq \theta_3 \leqq 45°$ $(=\Phi 2-\Phi 1)$;

(iv) First Decreasing Radius Portion DE: $30° < \theta_4 \leqq 90°$ $(=\Phi 3-\Phi 2)$;

(v) Second Constant Radius Portion EF: $0° \leqq \theta_5 \leqq 30°$ $(=\Phi 4-\Phi 3)$;

(vi) Second Decreasing Radius Portion FG: $5° \leqq \theta_6 \leqq 45°$ $(=\Phi 5-\Phi 4)$;

(vii) Second Regularly Circular Portion GH: $0° \leqq \theta_7 \leqq 10°$ $(=180°-\Phi 5)$.

Of the above seven curved surface elements, the increasing radius portion BC and the first and second decreasing radius portions DE and FG are essential for achieving the object of the invention and are therefore indispensable. The increasing radius portion BC has its circumferential angle set at a value smaller than 90° as noted above, so as to achieve an advanced timing of the increase of the compression pressure (fluid pressure in the pumping chamber) in the initial low torque region of one operating cycle. On the other hand, the first and second decreasing radius portions DE and FG should have their combined proportion of the camming peripheral surface for one operating cycle (i.e. the sum of their circumferential lengths) set at a value as large as possible. According to the invention, the sum of the circumferential lengths of these portions DE and FG is set at a value larger than 50 percent but smaller than or equal to 75 percent (i.e. $90° < \theta_4+\theta_6 \leqq 135°$) of the whole circumferential lengths of the one cycle performing portion. Further, the first and second decreasing radius portions DE and FG each have such a cam profile that the amount of protrusion of each vane from the rotor varies very gently as the vane moves from the starting end of the portion DE or FG to the terminating end, and that the rate at which the vane protruding amount varies gradually decreases toward the terminating end E or G of the portion DE or FG. Advantageously, the cam profiles of the portions DE and FG should be such that the distance between the camming peripheral surface and the center O of the rotor varies along a sine curve or a like curve from the starting end to the terminating end. Preferably, the increasing radius portion BC should also have a cam profile such that the above distance varies along a sine curve or a like curve. By providing the portions BC, DE and FG with such cam profiles, the vanes can slidingly move from one curved surface element to the next curved surface element with their amounts of protrusion varying in a streamline manner and by a slight value. Since the first and second decreasing radius portions DE and FG have the above-stated proportion and cam profile, the vanes have very low receding velocity or velocity of radially inward movement and also have their amounts of protrusion kept low enough to provide very low peak torque or sliding movement along these portions DE and FG during the compression stroke. Further, since the first and second decreasing radius portions DE and FG have a large combined proportion of the camming peripheral surface for one operating cycle as mentioned above, the torque curves obtained by the individual vanes have large overlapped portions to provide an even or flat synthetic torque curve, substantially reducing the total torque fluctuations.

The first and second constant radius portions CD and EF serve to keep the torque constant, contributing to further flattening of the total torque curve as compared with a total torque curve obtained by the first and second decreasing radius portions DE and FG alone. Even if the camming peripheral surface is provided with one or both of the first and second constant radius portions CD and EF, the combined proportion of the first and second decreasing radius portions DE and FG and one or both of the first and second constant radius portions CD and EF should preferably be set at a value falling in a range similar to the aforementioned one applied to the camming peripheral surface devoid of such constant radius portions, that is, a value larger than 50 percent but smaller than or equal to 75 percent.

The ratio of the vane protruding amount h at the terminating end of the increasing radius portion BC to the radius Ro of the rotor is preferably 0.1–0.5 to 1. The ratio of the vane protruding amount m at the terminating end of the first decreasing radius portion DE to the value h is preferably 0.3–0.7 to 1. By setting the proportions of the values h and m as above, the camming peripheral surface can have a generally gentle and streamline cam profile, effectively reducing the operating noise and vibration of the compressor.

I have theoretically reached the finding that if the cam profiles of the increasing radius portion BC, the first decreasing radius portion DE and the second decreasing radius portion FG are each designed by means of trigonometric function, the overall cam profile of the camming peripheral surface can be such that the rate of change of the velocity of radial movement of the vanes is small.

Figure 4:
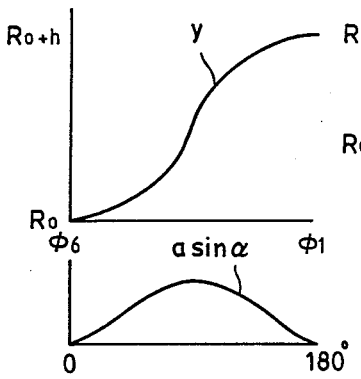
FIG. 4 is a graph showing the relationship between a curve of radial movement of vane obtained by the increasing radius portion of the camming peripheral surface of the invention and a sine curve used for designing the cam profile of the same portion.

Next, description will be made of the manner of calculating the cam profiles of the increasing radius portion BC, the first decreasing radius portion DE and the second decreasing radius portion FG, which vary along sine curves:

(a) Increasing Radius Portion BC: Let is be assumed that as shown in FIG. 4, the vane protruding amount increases from 0 to h as $\theta$ varies from $\Phi 6$ to $\Phi 1$ in FIG. 3, and during this increasing stroke, the vane protruding velocity varies at a rate corresponding to a sine curve sin $\alpha$ whose $\alpha$ varies from 0° to 180°. Provided that the vane protruding amount is defined as y, $$y = a \int_{o}^{\alpha} \sin \alpha \, d\alpha = a[-\cos \alpha]_o^{\alpha}$$

$$= a\{-\cos \alpha - (-1)\} = a(1 - \cos \alpha)$$

Since $y$ is equal to $h$ when $\alpha$ is 180°, $$h = a\,(1 - \cos 180°) = 2a$$

-continued $$\therefore a = \frac{h}{2}$$

$$\therefore y = \frac{h}{2}(1 - \cos\alpha)$$

Here, to replace $\alpha$ by $\theta$,
$\alpha : (\theta - \Phi 6) = 180° : (\Phi 1 - \Phi 6)$ $$\therefore \alpha = \frac{180°}{\Phi 1 - \Phi 6}(\theta - \Phi 6)$$

$$\therefore R = Ro + y = Ro + \frac{h}{2}\left[1 - \cos\frac{180°}{\Phi 1 - \Phi 6}(\theta - \Phi 6)\right]$$

$$= Ro + \frac{h}{2}\left[1 - \cos\left(\frac{180°}{\Phi 1 - \Phi 6}\theta - \frac{180°}{\Phi 1 - \Phi 6}\Phi 6\right)\right]$$

$$= Ro + h\sin^2\left[\frac{90°}{\Phi 1 - \Phi 6}(\theta - \Phi 6)\right]$$

Figure 5:
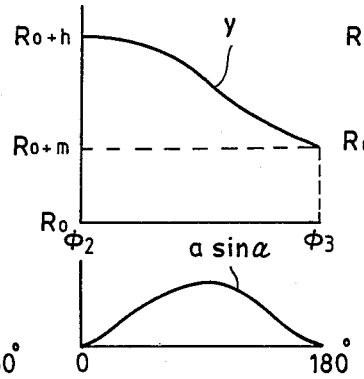
FIG. 5 is a graph showing the relationship between a curve of radial movement of vane obtained by the first decreasing radius portion of the invention and a sine curve used for designing the cam profile of the same portion.

(b) First Decreasing Radius Portion DE: Assuming that as shown in FIG. 5, the vane protruding amount decreases from h to h-m as $\theta$ varies from $\Phi 2$ to $\Phi 3$ in FIG. 3, and the sine curve $\sin\alpha$ has its $\alpha$ value varying from 0° to 180°:

$$y = h - a(1 - \cos\alpha)$$

Since $y$ is equal to $m$ when $\alpha$ is 180°, $$m = h - a \times 2 \quad \therefore a = \frac{h - m}{2}$$

$$\therefore y = h - \frac{h - m}{2}(1 - \cos\alpha)$$

Here, to replace $\alpha$ by $\theta$,
$\alpha : (\theta - \Phi 2) = 180° : (\Phi 3 - \Phi 2)$ $$\therefore \alpha = \frac{180°}{\Phi 3 - \Phi 2}(\theta - \Phi 2)$$

$$\therefore R = Ro + y = Ro + h - \frac{h - m}{2}\left[1 - \cos\frac{180°}{\Phi 3 - \Phi 2}(\theta - \Phi 2)\right]$$

$$= Ro + h - \frac{h - m}{2}\left[1 - \cos\left(\frac{180°}{\Phi 3 - \Phi 2}\theta - \frac{180°}{\Phi 3 - \Phi 2}\Phi 2\right)\right]$$

$$= Ro + h - (h - m)\sin^2\left[\frac{90°}{\Phi 3 - \Phi 2}(\theta - \Phi 2)\right]$$

Figure 6:
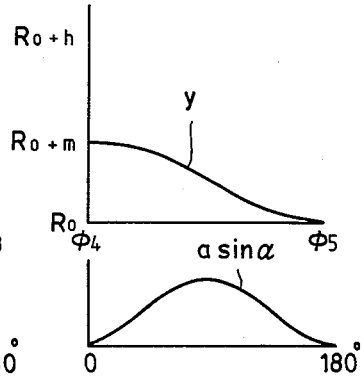
FIG. 6 is a graph showing the relationship between a curve of radial movement of vane obtained by the second decreasing radius portion of the camming peripheral surface of the invention and a sine curve used for designing the cam profile of the same portion.
Figure 7:
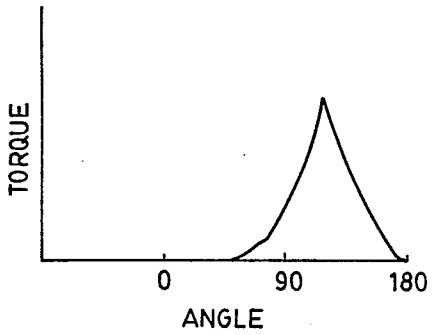
FIG. 7 PRIOR ART
FIG. 7 is a graph showing a torque curve plotted as if obtained by individual one of the vanes of a conventional double pumping chamber-type vane compressor.

(c) Second Decreasing Radius Portion FG: Assuming that as shown in FIG. 6, the vane protruding amount decreases from m to 0 as $\theta$ varies from $\Phi 4$ to $\Phi 5$ in FIG. 3, and the sine curve $\sin\alpha$ has its $\alpha$ value varying from 0° to 180°:

$$y = m - a(1 - \cos\alpha)$$

Since $y$ is equal to 0 when $\alpha$ is 180°, $$0 = m - a \times 2 \quad \therefore a = \frac{m}{2}$$

$$\therefore y = m - \frac{m}{2}(1 - \cos\alpha)$$

-continued

Here, to replace $\alpha$ by $\theta$,
$\alpha : (\theta - \Phi 4) = 180° : (\Phi 5 - \Phi 4)$ $$\therefore \alpha = \frac{180°}{\Phi 5 - \Phi 4}(\theta - \Phi 4)$$

$$\therefore R = Ro + y = Ro + m - \frac{m}{2}\left[1 - \cos\frac{180°}{\Phi 5 - \Phi 4}(\theta - \Phi 4)\right]$$

$$= Ro + \frac{m}{2}\left[1 + \cos\frac{180°}{\Phi 5 - \Phi 4}(\theta - \Phi 4)\right]$$

$$= Ro + \frac{m}{2}\left[1 + \cos\left(\frac{180°}{\Phi 5 - \Phi 4}\theta - \frac{180°}{\Phi 5 - \Phi 4}\Phi 4\right)\right]$$

$$= Ro + m - m\sin^2\left[\frac{90°}{\Phi 5 - \Phi 4}(\theta - \Phi 4)\right]$$

Calculations were carried out to determine actual size values of the curved surface elements for a double pumping chamber-type vane compressor, by applying the following preferred parameter values to the equations determined above:

$\Phi 1 = 60°$ $\Phi 2 = 75°$ $\Phi 3 = 120°$ $\Phi 4 = 135°$ $\Phi 5 = \Phi 6 = 0$ Ro=36 mm h=8 mm m=2.5 mm

The size values of the curved surface elements determined are as follows:

Increasing Radius Portion BC: $\theta = 0°$–$60°$, $R = 40 - 4\cos 3\theta$ (mm);

First Constant Radius Portion CD: $\theta = 60°$–$75°$, R=44 (mm);

First Decreasing Radius Portion DE: $\theta = 75°$–$120°$, $R = 41.25 + 2.75\cos(4\theta - 300)$ (mm);

Second Constant Radius Portion EF: $\theta = 120°$–$135°$, R=38.5 (mm); and

Second Decreasing Radius Portion FG: $\theta = 135°$–$180°$, $R = 37.25 + 1.25\cos(4\theta - 540)$ (mm)

In the camming peripheral surface according to the above example, the first and second regularly circular portions AB and GH are omitted.

Figure 8:
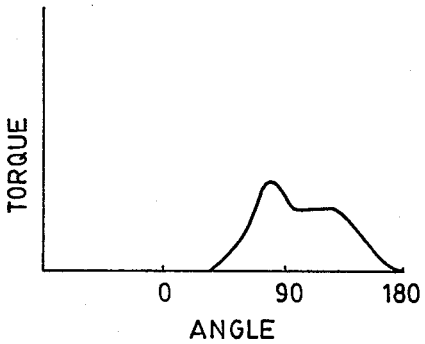
FIG. 8 is a graph similar to FIG. 7, showing a torque curve obtained by a double pumping chamber-type vane compressor according to the present invention.
Figure 9:
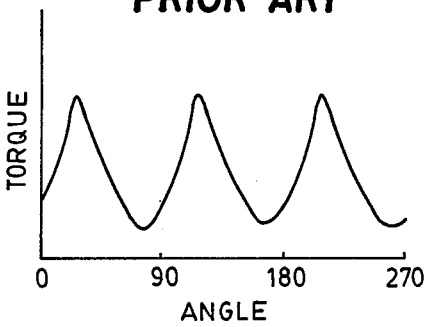
FIG. 9 PRIOR ART
FIG. 9 is a graph showing a torque curve plotted as if obtained by all the four vanes of a conventional double pumping chamber-type vane compressor.
Figure 10:
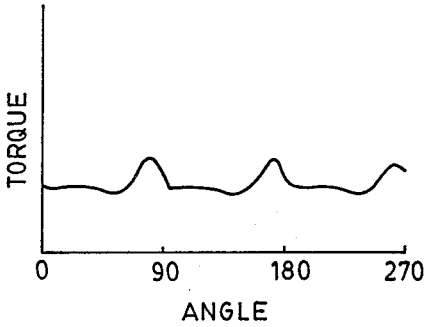
FIG. 10 is a graph similar to FIG. 9, showing a torque curve obtained by a double pumping chamber-type vane compressor according to the present invention.

FIGS. 7 through 10 show in a comparative manner torque curves obtained by a conventional double pumping chamber-type vane compressor and by a double pumping chamber-type vane compressor according to the present invention, to which the aforementioned calculated size values are applied. According to the present invention, as shown in FIGS. 8 and 10, the peak torque value is lower by about 40 percent than that obtained by the conventional compressor shown in FIGS. 7 and 9. Further, the torque curve according to the present invention is generally flat as compared with the conventional one, leading to effective reduction in the operating noise and vibration of the compressor.

Although the foregoing description is directed to the camming peripheral surface of a double pumping chamber-type vane compressor, the present invention can of course be applied to a single pumping chamber-type vane compressor as well. In the case of a single pumping chamber-type compressor, one operating cycle of suction, compression and discharge of fluid is carried out through 360 degrees, i.e. over the whole circumference. Although in the single pumping chamber-type compressor the aforementioned curved surface elements are formed continuously along the whole periphery extending through 360 degrees, the first regularly circular portion is located at a location immediately following the second decreasing radius portion with the second regularly circular portion omitted, as distinct from the double pumping chamber-type vane compressor.

Figure 11:
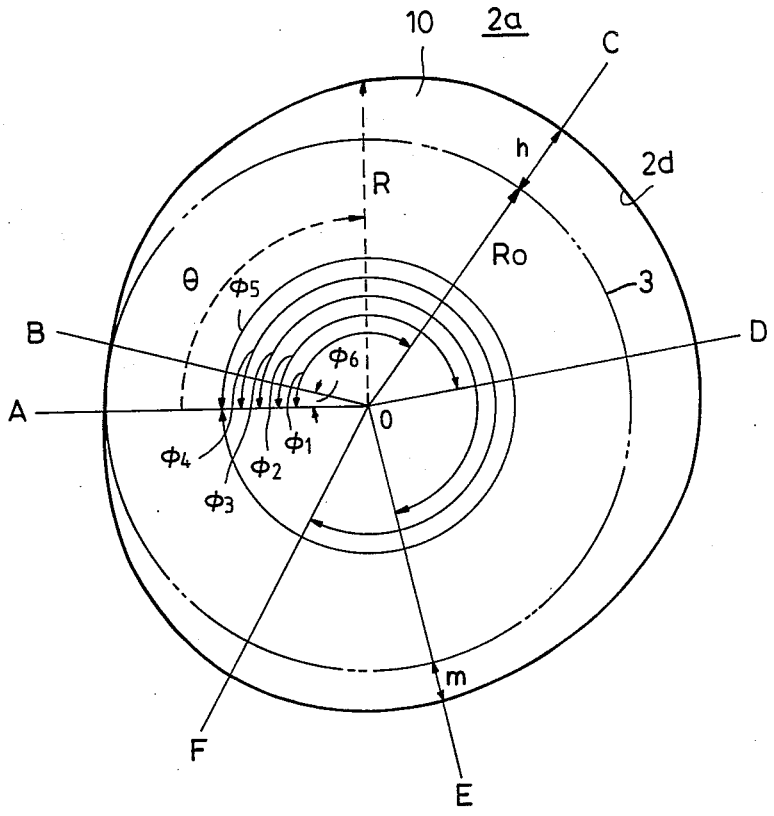
FIG. 11 is a schematic view showing a cam profile of the camming peripheral surface according to another embodiment of the present invention.

FIG. 11 shows an exemplary cam profile of a single pumping chamber-type vane compressor according to the present invention. In the figure, the reference numerals and the symbols identical with those in FIG. 3 designate corresponding elements and values. The camming peripheral surface shown in FIG. 11 comprises the following curved surface elements:

a. A regularly circular portion AB satisfying the relationships of $0° \leqq \theta \leqq \Phi 6$ and $R = Ro$;

b. An increasing radius portion BC satisfying the relationships of $\Phi 6 < \theta \leqq \Phi 1$ and R increasing from Ro to Ro+h;

c. A first constant radius portion CD satisfying the relationships of $\Phi 1 < \theta \leqq \Phi 2$ and $R = Ro + h$;

d. A first decreasing radius portion DE satisfying the relationships of $\Phi 2 < \theta \leqq \Phi 3$ and R decreasing from Ro+h to Ro+m;

e. A second constant radius portion EF satisfying the relationships of $\Phi 3 < \theta \leqq \Phi 4$ and $R = R + m$; and f. A second decreasing radius portion FA satisfying the relationships of $\Phi 4 < \theta \leqq \Phi 5$ and R decreasing from Ro+m to Ro.

The above curved surface elements AB, BC, CD, DE, EF and FA circumferentially extend, respectively, through the following angles $\theta_1$, $\theta_2$, $\theta_3$, $\theta_4$, $\theta_5$ and $\theta_6$ with respect to the center O of the rotor:

(i) First Regularly Circular Portion AB: $0° \leqq \theta_1 \leqq 20°$ $(=\Phi 6)$;

(ii) Increasing Radius Portion BC: $90° \leqq \theta_2 < 180°$ $(=\Phi 1 - \Phi 6)$;

(iii) First Constant Radius Portion CD: $0° \leqq \theta_3 \leqq 90°$ $(=\Phi 2 - \Phi 1)$;

(iv) First Decreasing Radius Portion DE: $60° \leqq \theta_4 \leqq 180°$ $(=\Phi 3 - \Phi 2)$;

(v) Second Constant Radius Portion EF: $0° \leqq \theta_5 \leqq 60°$ $(=\Phi 4 - \Phi 3)$;

(vi) Second Decreasing Radius Portion FA: $10° \leqq \theta_6 \leqq 90°$ $(=\Phi 5 - \Phi 4)$ Of the above six curved surface elements, the increasing radius portion BC, the first decreasing radius portion DE and the second decreasing radius portion FA are essential for achieving the object of the present invention and are therefore indispensable for the same reasons as previously described with reference to the double pumping chamber-type vane compressor. The cam profiles, proportions and functions of these essential portions BC, DE and FA as well as the manner of calculating the cam profiles are substantially identical with those previously described with reference to the double pumping chamber-type vane compressor, description of which is therefore omitted. Also, the functions of the regularly circulation portion AB and the first and second constant radius portions CD and EF are substantially identical with those of the double pumping chamber-type vane compressor, and therefore their description is also omitted.

What is claimed is:

1. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for rotating said rotor; whereby rotation of said rotor causes said vanes to slidingly move along said endless camming inner peripheral surface of said pump housing in a predetermined circumferential direction to define at least one pumping chamber between the inner surfaces of said pump housing, the outer peripheral surface of said rotor and said vanes, for performing suction, compression and discharge of fluid, the improvement wherein said endless camming inner peripheral surface of said pump housing has at least one portion for performing one cycle of suction, compression and discharge of fluid in cooperation with said vanes and said rotor, said at least one portion comprising:

an increasing radius portion along which the amount of protrusion of each of said vanes from said rotor gradually increases with the movement of the vane;

a first decreasing radius portion along which the amount of protrusion of said each vane from the rotor gradually decreases with the movement of said each vane; and a second decreasing radius portion along which the amount of protrusion of said each vane from the rotor gradually decreases with the movement of said each vane;

said increasing radius portion, said first decreasing radius portion and said second decreasing radius portion being successively arranged in the order mentioned in said predetermined moving direction of said vanes, each of said three portions having a starting end and a terminating end and having a cam profile such that each of said vanes has velocity of radial movement thereof varying at a rate gradually decreasing as said each vane approaches the terminating end of said each portion;

at least one of said increasing radius portion, said first decreasing radius portion and said second decreasing radius portion having a cam profile such that the distance between the camming surface of said at least one portion and the center of said rotor varies along a sine curve; and said increasing radius portion having a cam profile obtained by the following equation:

$$R = Ro + h \sin^2 (90°/\Phi a)\theta a$$

where

R = the distance between the center of the rotor and the camming surface of the increasing radius portion, Ro = the radius of the rotor, h = the amount of protrusion of each vane from the rotor at the terminating end of the increasing radius portion, $\Phi a$ = the angle through which the increasing radius portion circumferentially extends about the center of the rotor, and $\theta a$ = the angle at which tip of each vane moving from the starting end of the increasing radius portion toward the terminating end thereof lies apart from the starting end of the increasing radius portion with respect to the center of the rotor.

2. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for rotating said rotor; whereby rotation of said rotor causes said vanes to slidingly move along said endless camming inner peripheral surface of said pump housing in a predetermined circumferential direction to define at least one pumping chamber between the inner surfaces of said pump housing, the outer peripheral surface of said rotor and said vanes, for performing suction, compression and discharge of fluid, the improvement wherein said endless camming inner peripheral surface of said pump housing has at least one portion for performing one cycle of suction, compression and discharge of fluid in cooperation with said vanes and said rotor, said at least one portion comprising:

an increasing radius portion along which the amount of protrusion of each of said vanes from said rotor gradually increases with the movement of the vane;

a first decreasing radius portion along which the amount of protrusion of said each vane from the rotor gradually decreases with the movement of said each vane; and a seconnd decreasing radius portion along which the amount of protrusion of said each vane from the rotor gradually decreases with the movement of said each vane;

said increasing radius portion, said first decreasing radius portion and said second decreasing radius portion being successively arranged in the order mentioned in said predetermined moving direction of said vanes, each of said three portions having a starting end and a terminating end and having a cam profile such that each of said vanes has velocity of radial movement thereof varying at a rate gradually decreasing as said each vane approaches the terminating end of said each portion;

at least one of said increasing radius portion, said first decreasing radius portion and said second decreasing radius portion having a cam profile such that the distance between the camming surface of said at least one portion and the center of said rotor varies along a sine curve; and said first decreasing radius portion having a cam profile obtained by the following equation and inequality:

$$R = Ro + h(h-m)\sin^2(90°/\Phi b)\theta b, \text{ and } h > m$$

where

R = the distance between the center of the rotor and the camming surface of the first decreasing radius portion, Ro = the radius of the rotor, h = the amount of protrusion of each vane from the rotor at the terminating end of the increasing radius portion, m = the amount of protrusion of each vane from the rotor at the terminating end of the first decreasing radius portion, $\Phi b$ = the angle through which the frist decreasing radius portion circumferentially extends about the center of the rotor, and $\theta b$ = the angle at which tip of each vane moving from the starting end of the first decreasing radius portion toward the terminating end thereof lies apart from the starting end of the same portion with respect to the center of the rotor.

3. In a vane compressor including: a pump housing having inner surfaces thereof formed with an endless camming inner peripheral surface; a cylindrical rotor rotatably received within said pump housing, said rotor having an outer peripheral surface thereof formed therein with a plurality of axial slits; a plurality of vanes radially movably fitted in said slits of said rotor; and a drive shaft coupled to said rotor for rotating said rotor; whereby rotation of said rotor causes said vanes to slidingly move along said endless camming inner peripheral surface of said pump housing in a predetermined circumferential direction to define at least one pumping chamber between the inner surfaces of said pump housing, the outer peripheral surface of said rotor and said vanes, for performing suction, compression and discharge of fluid, the improvement wherein said endless camming inner peripheral surface of said pump housing has at least one portion for performing one cycle of suction, compression and discharge of fluid in cooperation with said vanes and said rotor, said at least one portion comprising:

an increasing radius portion along which the amount of protrusion of each of said vanes from said rotor gradually increases with the movement of the vane;

a first decreasing radius portion along which the amount of protrusion of said each vane from the rotor gradually decreases with the movement of said each vane; and a second decreasing radius portion along which the amount of protrusion of said each vane from the rotor gradually decreases with the movement of said each vane;

said increasing radius portion, said first decreasing radius portion and said second decreasing radius portion being successively arranged in the order mentioned in said predetermined moving direction of said vanes, each of said three portions having a starting end and a terminating end and having a cam profile such that each of said vanes has velocity of radial movement thereof varying at a rate gradually decreasing as said each vane approaches the terminating end of said each portion;

at least one of said increasing radius portion, said first decreasing radius portion and said second decreasing radius portion having a cam profile such that the distance between the camming surface of said at least one portion and the center of said rotor varies along a sine curve; and said second decreasing radius portion having a cam profile obtained by the following equation:

$$R = Ro + m - m\sin^2(90°/\Phi c)\theta c$$

wherein

R = the center of the rotor and the camming surface of the second decreasing radius portion, Ro = the radius of the rotor, h=the amount of protrusion of each vanes from the rotor at the terminating end of the increasing radius portion, m=the amount of protrusion of each vane from the rotor at the terminating end of the first decreasing radius portion, Φc=the angle through which the second decreasing radius portion circumferentially extends about the center of the rotor, and θc=the angle at which tip of each vane moving from the starting end of the second decreasing radius portion toward the terminating end thereof lies apart from the starting end of the same portion with respect to the center of the rotor.

4. The vane compressor as claimed in any one of claims 1, 2 or 3, wherein said one cycle performing portion of said endless camming inner peripheral surface further includes a first constant radius portion located between said increasing radius portion and said first decreasing radius portion and along which the amount of protrusion of each vane from the rotor is kept substantially constant with the movement of the vane, said first constant radius portion having a starting end and a terminating end between which the same portion has a camming surface thereof kept at a distance from the center of the rotor, which is obtained by the following equation:

$$R=Ro+h$$

where

R=the distance between the center of the rotor and the camming surface of the first constant radius portion, Ro=the radius of the rotor, and h=the amount of the protrusion of each vane from the rotor at the terminating end of the increasing radius portion.

5. The vane compressor as claimed in any one of claims 1, 2 or 3, wherein said one cycle performing portion of said endless camming inner peripheral surface further includes a second constant radius portion located between said first decreasing radius portion and said second decreasing radius portion and along which the amount of protrusion of each vane from the rotor is kept substantially constant with the movement of each vane, said second constant radius portion having a starting end and a terminating end between which the same portion has a camming surface thereof kept at a distance from the center of the rotor, which is obtained by the following equation:

$$R=Ro+m$$

where

R=the distance between the center of the rotor and the camming surface of the second constant radius portion, Ro=the radius of the rotor, and m=the amount of the protrusion of each vane from the rotor at the terminating end of the first decreasing radius portion.

6. The vane compressor as claimed in any one of claims 1, 2 or 3, wherein said one cycle performing portion of said endless camming inner peripheral surface further includes at least one third constant radius portion located at one of a location immediately preceding said increasing radius portion and a location immediately following said second decreasing radius portion in said predetermined moving direction of said vanes, along which sealing is effected between said rotor and said pump housing, said third constant radius portion having a starting end and a terminating end between which the same portion has a camming surface thereof kept at a distance from the center of the rotor, which is obtained by the following equation:

$$R=Ro$$

where

R=the distance between the center of the rotor and the camming surface of the third constant radius portion, and Ro=the radius of the rotor.

7. The vane compressor as claimed in any one of claims 1, 2 or 3, wherein said one cycle performing portion of said endless camming inner peripheral surface further includes: a first constant radius portion located between said increasing radius portion and said first decreasing radius portion and along which the amount of protrusion of each vane from the rotor is kept substantially constant with movement of the rotor; a second constant radius portion located between said first decreasing radius portion and said second decreasing radius portion and along which the amount of protrusion of each vane from the rotor is kept substantially constant with movement of the vane; and at least one third constant radius portion located at one of a location immediately preceding said increasing radius portion and a location immediately following said second decreasing radius portion in said predetermined moving direction of said vanes, and along which sealing is effected between said rotor and said pump housing; said first, second and third constant radius portions each having a starting end and a terminating end between which the same portion has a camming surface thereof kept at a distance from the center of the rotor, which is obtained by the following equation:

$$R_1=Ro+h \quad (1)$$

$$R_2=Ro+m \quad (2)$$

$$R_3=Ro \quad (3)$$

where $R_1$=the distance between the center of the rotor and the camming surface of the first constant radius portion, $R_2$=the distance between the center of the rotor and the camming surface of the second constant radius portion, $R_3$=the distance between the center of the rotor and the camming surface of the third constant radius portion, Ro=the radius of the rotor, h=the amount of protrusion of each vane from the rotor at the terminating end of said increasing radius portion, and m=the amount of the protrusion of each vane from the rotor at the terminating end of the first decreasing radius portion.

8. The vane compressor as claimed in any one of claims 1, 2, or 3, wherein said first decreasing radius portion and said second decreasing radius portion have a combined circumferential length larger than 50 percent but smaller than or equal to 75 percent of the whole circumferential length of said one cycle performing portion of said endless camming inner peripheral surface of said pump housing.

9. The vane compressor as claimed in any one of claims 1, 2 or 3, wherein said pump housing includes at least one fluid inlet port and at least one fluid outlet port formed therein; only one of said at least one fluid outlet port being disposed near said terminating end of said second decreasing radius portion and only one of said at least one fluid inlet port being disposed near the starting end of said increasing radius portion; whereby fluid is introduced into said pumping chamber through said one fluid inlet port as said vanes move along said increasing radius portion, said introduced fluid being compressed as said vanes move along said first decreasing radius portion, said compressed fluid being further compressed and discharged through said one fluid outlet port from said pumping chamber as said vanes move along said second decreasing radius portion.

10. The vane compressor as claimed in claim 9, wherein said first decreasing radius portion and said second decreasing radius portion have a combined circumferential length larger than 50 percent but smaller than or equal to 75 percent of the whole circumferential length of said one cycle performing portion of said endless camming inner peripheral surface of said pump housing.

* * * * *